US009562310B2

(12) United States Patent
Han et al.

(10) Patent No.: US 9,562,310 B2
(45) Date of Patent: Feb. 7, 2017

(54) CLOTH TREATING APPARATUS HAVING A HOT AIR SUPPLY DEVICE

(75) Inventors: Dong Joo Han, Changwon-si (KR); Chul Jin Choi, Changwon-si (KR); Young Bok Son, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1530 days.

(21) Appl. No.: 12/594,144

(22) PCT Filed: Apr. 4, 2008

(86) PCT No.: PCT/KR2008/001908

§ 371 (c)(1),
(2), (4) Date: Jun. 21, 2010

(87) PCT Pub. No.: WO2008/123699

PCT Pub. Date: Oct. 16, 2008

(65) Prior Publication Data

US 2011/0030428 A1 Feb. 10, 2011

(30) Foreign Application Priority Data

Apr. 4, 2007 (KR) ..... 10-2007-0033313

(51) Int. Cl.
*D06F 29/00* (2006.01)
*D06F 39/12* (2006.01)
*D06F 58/10* (2006.01)

(52) U.S. Cl.
CPC ..... *D06F 29/00* (2013.01); *D06F 29/005* (2013.01); *D06F 39/125* (2013.01); *D06F 58/10* (2013.01)

(58) Field of Classification Search
USPC ..... 68/5 C, 5 R, 20, 27; 34/210, 218, 487, 34/493, 497, 595, 596
See application file for complete search history.

(56) References Cited

U.S. PATENT DOCUMENTS 6,973,740 B2 * 12/2005 Meyer ..... 34/224
8,769,997 B2 * 7/2014 Moon ..... D06F 25/00 68/3 R
2004/0134087 A1 7/2004 Meyer
2005/0172678 A1 8/2005 Kim et al.
2005/0178165 A1 * 8/2005 Carey et al. ..... 68/12.05
2005/0275325 A1 12/2005 Yang
2006/0150689 A1 7/2006 Kim et al.
2006/0151009 A1 * 7/2006 Kim et al. ..... 134/42
2006/0156765 A1 7/2006 Sunshine et al.
2007/0151120 A1 * 7/2007 Tomasi et al. ..... 34/601
(Continued)

FOREIGN PATENT DOCUMENTS

CN 1517483 A 8/2004
EP 1146161 A1 * 10/2001 ..... D06F 58/04
(Continued)

*Primary Examiner* — Michael Barr
*Assistant Examiner* — Benjamin L Osterhout
(74) *Attorney, Agent, or Firm* — Birch, Stewart, Kolasch & Birch, LLP

(57) ABSTRACT

A cloth treating apparatus is disclosed. The cloth treating apparatus comprises a main body washing or drying clothes, and an auxiliary treating apparatus including a cabinet provided at one side of the main body; and a drawer slidably provided in the cabinet to form a accommodating space, having a hot air supply device, wherein the hot air supply device supplies a hot air to the accommodating space and is provided on an external rear surface of the drawer.

12 Claims, 4 Drawing Sheets

(56) References Cited

U.S. PATENT DOCUMENTS

| | | | | |
|---|---|---|---|---|
| 2007/0151310 | A1* | 7/2007 | Wright et al. | 68/3 R |
| 2008/0053162 | A1* | 3/2008 | Park et al. | 68/13 R |

FOREIGN PATENT DOCUMENTS

| | | | |
|---|---|---|---|
| EP | 1 439 258 | A2 | 7/2004 |
| JP | 54-108060 | A | 8/1979 |
| JP | 10-216399 | A | 8/1998 |
| KR | 10-2005-0115968 | A | 12/2005 |
| KR | 10-0535684 | B1 | 12/2005 |
| KR | 10-0710315 | B1 | 4/2007 |
| KR | 10-0755865 | B1 | 9/2007 |
| KR | 10-0774212 | B1 | 11/2007 |

* cited by examiner

CLOTH TREATING APPARATUS HAVING A HOT AIR SUPPLY DEVICE

TECHNICAL FIELD

The present invention relates to a cloth treating apparatus, and more particularly, to a cloth treating apparatus comprising an auxiliary treating apparatus which is provided in a main body, which performs washing and drying, to enable drying of objects of small quantity to be dried.

BACKGROUND ART

Generally, a cloth treating apparatus means an apparatus that can wash, dry, or both wash and dry clothes, etc. The cloth treating apparatus performs either a washing function or a drying function, or can perform both washing and drying functions. Also, a cloth treating apparatus having a steam supply device has spread recently, wherein the steam supply device performs a refresh function of clothes, etc., such as wrinkles removing, smell removing, and electrostatic removing.

Meanwhile, conventional cloth treating apparatuses are divided into a front loading type and a top loading type depending on a loading direction of clothes. Also, the cloth treating apparatuses are divided into a vertical type and a horizontal type depending on a washing type, wherein the vertical type includes a pulsator or an inner tub which is rotated, and the horizontal type includes a drum which is arranged horizontally and rotated. Examples of the horizontal type cloth treating apparatus include a drum washing machine and a drum dryer.

Recently, such cloth treating apparatuses are on a large-scaled trend to meet user's request. In other words, outer sizes of cloth treating apparatuses for home use are on a large-scaled trend.

In accordance with such a large-scaled trend, a large-scaled apparatus should be driven to dry objects of small quantity. In this case, a problem occurs in that it is disadvantageous in view of energy saving.

In case of a drum type dryer, since a drum is rotated to tumble objects to be dried, a problem occurs in that the drum type dryer is not suitable for drying of footwear, etc. Furthermore, it is general that footwear of small quantity such as a pair of footwear or two pairs of footwear is washed. In this way, when a conventional dryer is used to dry objects of small quantity, since a drum should be driven and a heater and a fan with high capacity should be driven, it is inefficient in view of energy.

In this respect, instead of the conventional large-scaled washing machine, a small-scaled dryer having capacity smaller than that of the large-scaled washing machine is required. However, it is not desirable in view of space use and a fine view that two washing machines are provided for each home even though one of the washing machines has a small scale.

DISCLOSURE OF INVENTION

Technical Problem

Accordingly, the present invention is directed to a cloth treating apparatus which substantially obviates one or more problems due to limitations and disadvantages of the related art.

An object of the present invention is to provide an improved cloth treating apparatus comprising an auxiliary treating apparatus which is provided at a lower or upper part of the cloth treating apparatus to perform drying for objects of small quantity without driving the cloth treating apparatus of large capacity.

Another object of the present invention is to provide an improved cloth treating apparatus comprising an auxiliary treating apparatus which is advantageous for energy saving unlike a conventional dryer of a drum type.

Other object of the present invention is to provide an auxiliary treating apparatus which removes a smell of objects, such as shoes, which require deodorization, and refreshes the objects.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

Technical Solution

To achieve these objects and other advantages and in accordance with the purpose of the invention, as embodied and broadly described herein, a cloth treating apparatus comprises an auxiliary treating apparatus, which includes a main body washing or drying clothes; a cabinet provided at one side of the main body; and a drawer slidably provided in the cabinet to form a accommodating space, having a hot air supply device device, which supplies a hot air to the accommodating space and is provided on an external rear surface. In this case, the drawer is slidably provided at an upper part or a lower part of the main body.

Meanwhile, the hot air supply device includes: a housing provided with an inlet into which external air flows; a heater heating the flown air; and a ventilating fan ventilating the air to supply the air to the accommodating space of the drawer. The hot air supply device further includes a filter provided at the inlet.

In this case, the ventilating fan is provided to enable its speed control so that it has a variable speed. Also, the ventilating fan is comprised of an intake fan which forcibly supplies the external air into the drawer through the inlet. Alternatively, the ventilating fan is comprised of an exhaust fan which forcibly supplies the air inside the drawer to the outside. If the ventilating fan is comprised of the intake fan, the heater is provided at the front of the intake fan and heats the air flown through the intake fan.

Meanwhile, the auxiliary treating apparatus further includes a cover which is provided above the drawer and is selectively opened and closed. In this case, the housing or the cover is provided with an outlet which exhausts the air inside the drawer to the outside. Also, the auxiliary treating apparatus further includes a filter provided at the outlet.

Meanwhile, the auxiliary treating apparatus further includes an air guide provided at the drawer to guide the air which flows into the accommodating space.

Furthermore, the cloth treating apparatus further comprises an input unit provided at the drawer to allow a user to input a manipulation command, a display unit provided at the drawer to display an operation state of the auxiliary treating apparatus, and a main control unit controlling the hot air supply device in accordance with the command input from the input unit.

Alternatively, the main body of the cloth treating apparatus further includes an input unit allowing a user to input a manipulation command, a display unit displaying an operation state of the main body or the auxiliary treating apparatus, and a controller controlling the main body or the auxiliary treating apparatus in accordance with the command input from the input unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

BEST MODE FOR CARRYING OUT THE INVENTION

Hereinafter, reference will now be made in detail to the preferred embodiments of the present invention, examples of which are illustrated in the accompanying drawings.

Figure 1:
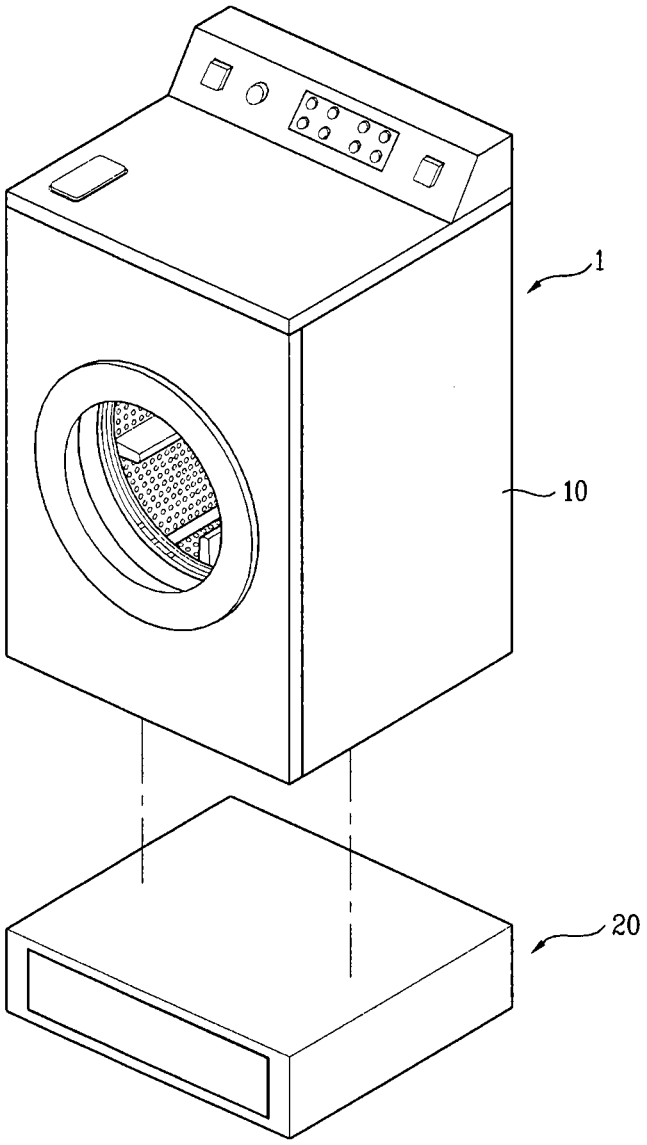
FIG. 1 is a perspective view illustrating a cloth treating apparatus.

FIG. 1 is a perspective view illustrating a cloth treating apparatus.

As shown in FIG. 1, a cloth treating apparatus 1 includes a main body 10 constituting appearance, and a control panel 11 arranged on a front surface or an upper surface of the main body 10. In this case, the control panel may include a controller which controls the operation of the cloth treating apparatus. Accordingly, a user performs cloth treating such as washing or drying by manipulating the control panel.

As shown in FIG. 1, the cloth treating apparatus could be a washing machine, a dryer, or a dryer with a washing function.

Meanwhile, the cloth treating apparatus 1 may include a support 20 which supports the main body 10 against the bottom. The main body 10 is arranged on an upper part of the support 20. However, the support 20 serves to support the washing machine or the dryer but is not used for the other functions. Accordingly, an auxiliary treating apparatus, which washes or dries clothes of small quantity in addition to support of the main body 10, has been required.

Hereinafter, such an auxiliary treating apparatus will be described in detail with reference to the accompanying drawings.

Figure 2:
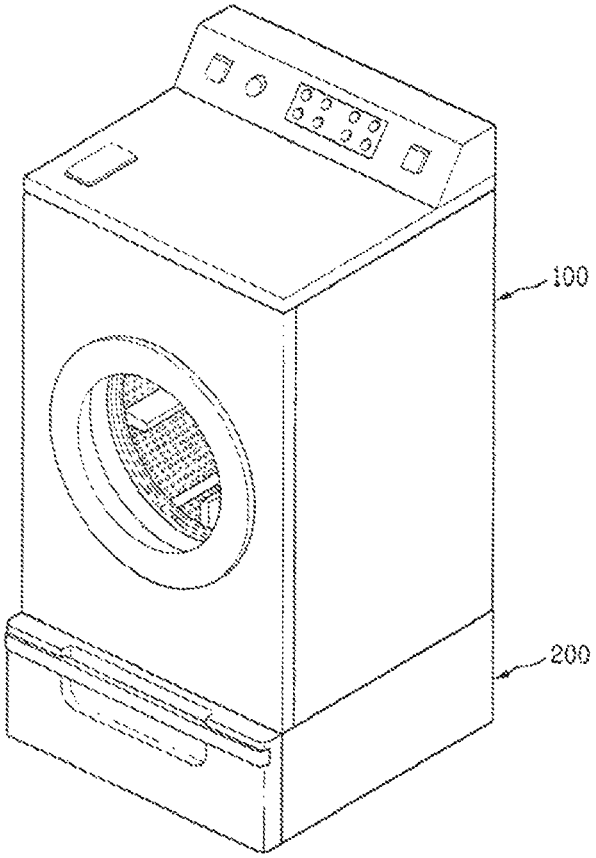
FIG. 2 is a perspective view illustrating a cloth treating apparatus comprising an auxiliary treating apparatus according to one preferred embodiment of the present invention.

FIG. 2 is a perspective view illustrating a cloth treating apparatus comprising an auxiliary treating apparatus according to the preferred embodiment of the present invention.

Referring to FIG. 2, the cloth treating apparatus according to the embodiment of the present invention can include a main body 100 which washes or dries clothes, and an auxiliary treating apparatus 200 provided at one side of the main body 100.

Accordingly, in this embodiment, the auxiliary treating apparatus 200 is provided at one side of the main body 100 which performs washing, drying or both washing and drying. For example, the auxiliary treating apparatus 200 may be provided at a lower part of the main body 100, or, although not shown, may be provided at an upper part of the main body 100. In this case, it is preferable that a controller of the main body 100, i.e., a control panel is formed on a front surface of the main body 100. Meanwhile, although not shown, the auxiliary treating apparatus 200 may be arranged at a side of the main body 100.

The auxiliary treating apparatus 200 may constitute a cloth treating apparatus for washing or drying in combination with the main body 100. In this case, clothes are received inside the main body 100 to perform washing or drying. In other words, the main body 100 could be a washing machine, a dryer, or a washing machine with drying function. Meanwhile, the auxiliary treating apparatus 200 may be connected to the lower part or the upper part of the main body 100 by a coupling means (not shown).

In the embodiment of the present invention, it is preferable that the auxiliary treating apparatus 200 has a volume smaller than that of the main body 100 which is fixed to the auxiliary treating apparatus 200. Also, it is preferable that the auxiliary treating apparatus 200 has a height lower than that of the main body 100. This is because that the auxiliary treating apparatus 200 is used to perform an auxiliary function of the main body 100 in the embodiment of the present invention.

Hereinafter, the auxiliary treating apparatus according to the preferred embodiments of the present invention will be described in detail with reference to the accompanying drawings.

Figure 3:
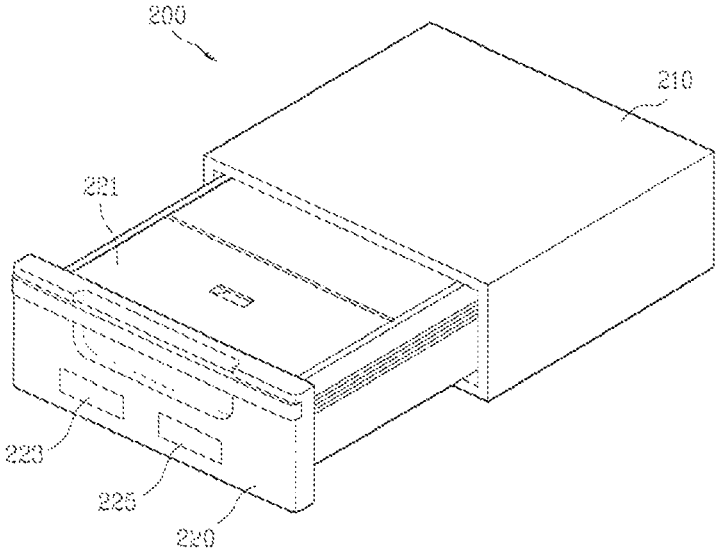
FIG. 3 is a perspective view illustrating an auxiliary treating apparatus of FIG. 2.
Figure 4:
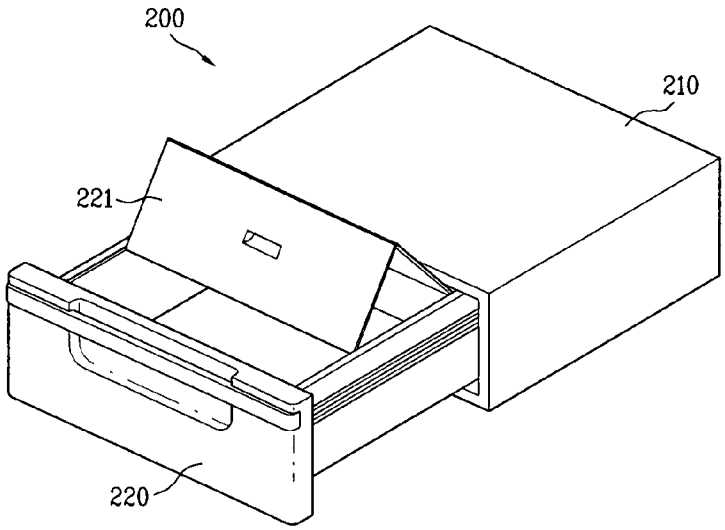
FIG. 4 is a perspective view illustrating the state that a cover in FIG. 3 is opened.

FIG. 3 is a perspective view illustrating an auxiliary treating apparatus according to the present invention, and FIG. 4 is a perspective view illustrating the state that a cover of an auxiliary treating apparatus according to the present invention is opened.

Referring to FIG. 3 and FIG. 4, the auxiliary treating apparatus 200 according to the embodiment of the present invention is provided with a accommodating space for receiving objects to be dried. In this case, the accommodating space can be formed inside a drawer 220 that can be drawn from a front surface of a cabinet 210 to the front, wherein the cabinet 210 forms appearance of the auxiliary treating apparatus 200.

A cover 221, which is selectively opened and closed, may be provided at an upper part of the drawer.

The cover 221 serves to cover an opening formed at a space for receiving the objects to be dried inside the drawer 220 to load or draw the objects. It is preferable that the cover 221 covers the opening in a state that the cover is unfolded as shown in FIG. 3 and opens the opening while being folded as shown in FIG. 4 if the user pushes a knob to the rear. In this case, when the auxiliary treating apparatus 200 performs drying, the cover 221 serves to prevent a hot air from leaking out through the opening, thereby reducing power loss.

Figure 5:
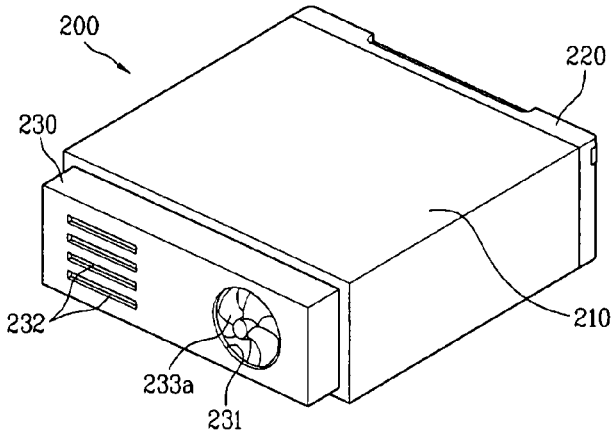
FIG. 5 is a perspective view illustrating a rear surface of an auxiliary treating apparatus of FIG. 2.

FIG. 5 is a perspective view illustrating a rear surface of the auxiliary treating apparatus according to the present invention.

As shown in FIG. 5, a hot air supply device 230 can be provided at one side of the drawer 220 to forcibly supply the hot air into the drawer 220. In this case, it is preferable that the hot air supply device 230 is formed on a rear surface of the drawer 220 to supply the hot air to the accommodating space of the drawer 220.

Figure 6:
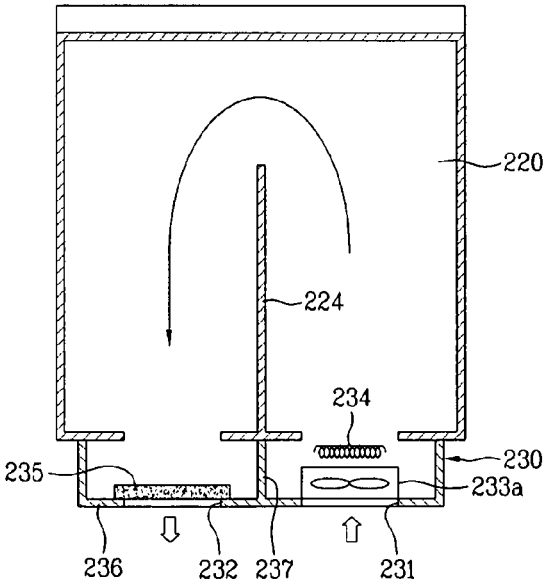
FIG. 6 is a cross-sectional view illustrating an auxiliary treating apparatus according to another preferred embodiment of the present invention.
Figure 7:
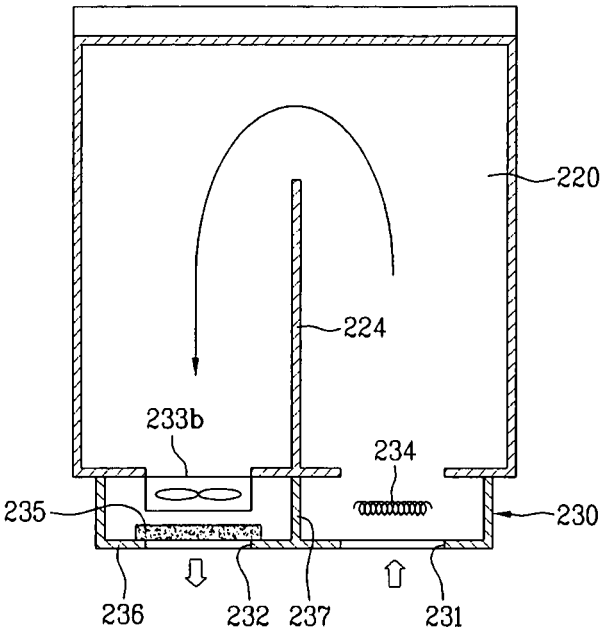
FIG. 7 is a cross-sectional view illustrating an auxiliary treating apparatus according to other preferred embodiment of the present invention.

FIG. 6 is a cross-sectional view illustrating an auxiliary treating apparatus according to another preferred embodiment of the present invention, and FIG. 7 is a cross-sectional view illustrating an auxiliary treating apparatus according to other preferred embodiment of the present invention.

Referring to FIG. 6 and FIG. 7, the hot air supply device 230 includes a housing 236 provided with an inlet 231, ventilating fans 233*a* and 233*b* ventilating the air, and a heater 234 heating the air, wherein the air flows into the inlet 231.

It is preferable that the housing 236 is connected with a rear wall of the drawer 220. Accordingly, the air flown into the hot air supply device 230 can be supplied into the drawer 220.

Furthermore, a filter (not shown) may be formed at the inlet 231 of the housing 236. Accordingly, external contaminant air can be prevented from being flown into the drawer 220. Meanwhile, the ventilating fans 233*a* and 233*b* allow the external air to be flown into the drawer 220 and then to be exhausted out. In this case, the external air is heated by the heater 234 and then flows into the drawer 220.

In this case, although the heater 234 can be provided in various types such as electric type, gas type, etc., it is preferable that an electric type heater occupying a small space is used considering the space is narrow in view of the feature of the auxiliary treating apparatus 200.

Accordingly, the auxiliary treating apparatus 200 according to the present invention can perform a drying function through the hot air supply device 230. In this case, it is preferable that the ventilating fans 233*a* and 233*b* are provided to enable its speed control, whereby the ventilating fans have a variable speed. In this way, ventilating speed can be controlled depending on the speed of the ventilating fans 233*a* and 233*b*, so that different operation modes can be selected depending on types and drying time of the objects to be dried, thereby perform drying.

Furthermore, it is preferable that the hot air supply device 230 is provided with the outlet 232 to exhaust the air inside the drawer 220 to the outside. Preferably, the outlet 232 is formed at the housing 236.

Accordingly, the air flown through the inlet 231 is exhausted out through the outlet 232 after drying is performed inside the drawer 220. In this case, it is preferable that a partition wall 237 is provided between the inlet 231 and the outlet 232. The partition wall 237 serves to prevent the air flown through the inlet 231 from being directly exhausted to the outlet 232 without circulating the air inside the drawer 220.

Furthermore, although not shown, the outlet may be formed at the cover 221. However, the locution of the outlet is not limited to the above location, and the outlet 232 may be formed anywhere the air can be exhausted after passing through the inside of the drawer 220.

Meanwhile, the outlet 232 may be provided with a filter 235. Preferably, the filter 235 serves as a deodorizing filter to remove a smell, which is generated when drying is performed. Meanwhile, when the smell generated from the objects dried by the auxiliary treating apparatus 200 has acidity, the filter 235 can remove the smell through a neutralizing reaction with alkali material. In this case, the filter may be formed of a porous active carbon treated with alkali treatment to remove such acidic smell.

Furthermore, the auxiliary treating apparatus according to the embodiment of the present invention may be provided with several filters having acidity or neutrality to remove other smell ingredients in addition to the filter treated with alkali. Moreover, a plurality of alkali treated adsorbents having a global shape or a cylindrical shape may be used in such a manner that they are arranged in a box type frame.

Furthermore, it is preferable that the drawer 220 is provided with an air guide 235 which guides the air to form a path of the air flown through the inlet 231. The air guide 224 serves to desirably supply the air to the front of the accommodating space inside the drawer 220 and at the same time to partition the path of the inflow air from the path of the exhausted air. Accordingly, collision between the inflow air and the exhausted air can be minimized to enhance efficiency of drying, etc. Also, since the air guide 224 concentrates the air along one direction with forming the path of the air, it is more efficient for drying.

Meanwhile, the ventilating fans 233*a* and 233*b* can be used by being divided into an intake fan 233*a* and an exhaust fan 233*b* in accordance with the embodiment of the present invention.

The hot air supply device 230 will be described depending on the type of the ventilating fans 233*a* and 233*b*. As shown in FIG. 6, the hot air supply device 230 according to the embodiment of the present invention can be provided with an intake fan 233*a* formed at the inlet 231 to forcibly supply the external air into the drawer 220. Accordingly, it is preferable that the heater 234 is provided at the front of the intake fan 233*a* to heat the air flown by the intake fan 233*a*.

The hot air supply device 230 according to another embodiment shown in FIG. 7 can be provided with an exhaust fan 233*b* which forcibly exhausts the air inside the drawer 220 to the outside. Accordingly, it is preferable that the exhaust fan 233*b* is provided at the front of the outlet 232.

In other words, if the exhaust fan 233*b* exhausts the air to the outside by inhaling the air from the front of the outlet 232, the air inside the auxiliary treating apparatus 200 flows into the inlet 231 as much as the exhausted range. Accordingly, the air flown through the inlet 231 is heated by the heater 234 formed at the front of the inlet, so that the air flows into the drawer 220.

As shown in FIG. 6 and FIG. 7, contrary to the inlet 231 and the outlet 232 of the hot air supply device 230, which are partitioned at both sides, the inlet 231 and the outlet 232 may be provided up and down so that the air flows into upper and lower parts and is exhausted to the lower part, or the air flows into the lower part and is exhausted to the upper part.

Meanwhile, the auxiliary treating apparatus 200 may include a control panel (not shown) formed on the front surface of the drawer 220. In other words, since the auxiliary treating apparatus includes an input unit 223, a display unit 225 and a main control unit, it can be operated independently without being dependent upon the main body 100. Knob and selection buttons which can select a drying course, etc. can be used as the input unit, and LCD screen and LED can be used as the display unit.

When the user intends to use the auxiliary treating apparatus 200, the user inputs a command related to drying through the input unit. Then, the main control unit controls the auxiliary treating apparatus in accordance with the input command. And, the main control unit displays information related to the operation state of the auxiliary treating apparatus through the display unit.

Accordingly, various types of drying modes can be performed depending on types of the objects to be dried. In other words, as the air is forcibly supplied into the space where objects to be dried are received, depending on the operation mode selected by the user, supply time of the air is changed.

Of course, driving of the auxiliary treating apparatus 200 may be controlled through the controller (not shown) of the main body 100. In this case, the controller of the auxiliary treating apparatus 200 may be omitted. Moreover, the input unit and the display unit may input and display the command through the main body 100.

Hereinafter, the operation of cloth treating apparatus comprising an auxiliary treating apparatus according to the embodiment of the present invention, which is constricted as above, will be described.

First of all, the user draws the drawer 220 to arrange the objects to be dried, such as clothes, shoes, and hats, on the drawer 220.

The user selects a desired operation mode depending on types of the laundry through the input unit. The operation mode can include various types of drying modes. In other words, the operation mode can be divided into drying time, speed control of ventilating fans, etc.

Accordingly, the hot air is forcibly supplied into the drawer 220 where the objects to be dried are received, through the hot air supply device 230 in accordance with the operation mode selected by the user. In other words, the air flows into the drawer 220 through the ventilating fan 133, and the flown air is heated by the heater 234, whereby the air is supplied into the accommodating space inside the drawer 220.

The air flown into the drawer 220 dries the objects to be dried, inside the drawer 220 along the path according to the air guide 224. The air which has passed through the objects to be dried is exhausted to the outside through the outlet 232.

Also, the smell generated during drying is removed by the filter formed at the outlet 224 when the air is exhausted to the outside through the outlet 232.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

INDUSTRIAL APPLICABILITY

According to the present invention, since the auxiliary treating apparatus, which enables drying of the objects of small quantity to be dried, is used without driving the cloth treating apparatus which is relatively great, it is possible to save energy along with convenient use.

It is possible to easily dry shoes, hats, and cloths, which are difficult to dry through the conventional drum type dryer.

In addition, it is possible to remove a smell of the objects to be dried, which require deodorization, such as shoes, and to refresh the objects.

Accordingly, according to the present invention, it is possible to provide the auxiliary treating apparatus of which use is convenient, by maximizing space use at the low cost.

The invention claimed is:

1. A cloth treating apparatus comprising:
- a main body washing or drying clothes;
- an auxiliary treating apparatus provided at one side of the main body, the auxiliary treating apparatus comprising:
  - a cabinet configured to form an appearance of the auxiliary treating apparatus;
  - a drawer slidably provided in the cabinet to form an accommodating space; and
  - a hot air supply device provided on an external rear surface of the drawer to supply hot air to the accommodating space, the hot air device comprising:
    - a housing connected with a rear wall of the drawer;
    - an inlet provided in a rear wall of the housing;
    - an outlet in the rear wall of the housing and closely positioned to the inlet; and
    - a partition wall for separating the inlet and the outlet at the rear wall of the housing, the partition wall provided between the inlet and the outlet to prevent air flowing through the inlet from being directly exhausted to the outlet,
    - wherein the inlet introduces external air to the drawer from a rear side of the drawer and the outlet discharges air inside the drawer to the rear side of the drawer,
  - an air guide provided in the drawer and extending from the partition wall, wherein the air guide supplies air to the front of the accommodation space and partitions the path of inflow air from the path of exhausted air,
  - wherein the housing is exposed to outside of the cabinet for the external air flowing through the inlet and the air inside the drawer exhausting through the outlet.

2. The cloth treating apparatus according to claim 1, wherein the drawer is slidably provided at an upper part or a lower part of the main body.

3. The cloth treating apparatus according to claim 1, wherein the hot air supply device further comprises:
- a heater heating air; and
- a ventilating fan supplying air to the accommodating space of the drawer.

4. The cloth treating apparatus according to claim 3, wherein the hot air supply device further includes a filter provided at the outlet.

5. The cloth treating apparatus according to claim 3, wherein the ventilating fan has variable speed.

6. The cloth treating apparatus according to claim 5, wherein the ventilating fan comprises an intake fan which forcibly supplies air into the drawer through the inlet.

7. The cloth treating apparatus according to claim 6, wherein the heater is provided at t the intake fan and heats air passing through the intake fan.

8. The cloth treating apparatus according to claim 5, wherein the ventilating fan is comprised of an exhaust fan which forcibly supplies the air inside the drawer to outside the drawer.

9. The cloth treating apparatus according to claim 3, further comprising a cover above the drawer, the drawer being selectively opened and closed.

10. The cloth treating apparatus according to claim 1, wherein the auxiliary treating apparatus further includes a filter provided at the outlet.

11. The cloth treating apparatus according to claim 1, further comprising:

an input unit provided at the drawer to allow a user to input a manipulation command; and a display unit provided at the drawer to display an operation state of the auxiliary treating apparatus.

12. The cloth treating apparatus according to claim 1, wherein the main body further comprises:

an input unit allowing a user to input a manipulation command;

a display unit displaying an operation state of the main body or the auxiliary treating apparatus; and a controller controlling the main body or the auxiliary treating apparatus in accordance with the command input from the input unit.

* * * * *